US006588492B1

(12) United States Patent
Fish et al.

(10) Patent No.: US 6,588,492 B1
(45) Date of Patent: Jul. 8, 2003

(54) STRIP CASTING APPARATUS

(75) Inventors: John Andrew Fish, Woonona (AU); Heiji Kato, Yokosuka (JP)

(73) Assignee: Castrip LLC, Charlotte, NC (US)

( * ) Notice: Subject to any disclaimer, the term of this patent is extended or adjusted under 35 U.S.C. 154(b) by 0 days.

(21) Appl. No.: 09/980,735

(22) PCT Filed: May 1, 2000

(86) PCT No.: PCT/AU00/00388

§ 371 (c)(1),
(2), (4) Date: Oct. 31, 2001

(87) PCT Pub. No.: WO00/66294

PCT Pub. Date: Nov. 9, 2000

(30) Foreign Application Priority Data

May 3, 1999 (AU) ..... PQ 0071

(51) Int. Cl.[7] ..... B22D 11/06
(52) U.S. Cl. ..... 164/428; 164/438
(58) Field of Search ..... 164/428, 435, 164/438, 439

(56) References Cited

U.S. PATENT DOCUMENTS 5,221,511 A * 6/1993 Fukase et al. ..... 266/45
5,385,199 A * 1/1995 Sakaguchi ..... 164/428
5,810,070 A 9/1998 Osada et al.
6,012,508 A * 1/2000 Folder ..... 164/480
6,073,680 A * 6/2000 Folder ..... 164/480
6,125,917 A * 10/2000 Cassar et al. ..... 164/428

FOREIGN PATENT DOCUMENTS

| | | |
|---|---|---|
| AU | 63175/99 | 7/2000 |
| EP | 0 829 320 A2 | 3/1998 |
| GB | 2 317 132 A | 3/1998 |

* cited by examiner

*Primary Examiner*—M. Alexandra Elve
*Assistant Examiner*—Len Tran
(74) *Attorney, Agent, or Firm*—Barnes & Thornburg

(57) ABSTRACT

Twin roll caster for casting metal strip comprises pair of parallel casting rolls forming nip to receive molten metal from elongate metal delivery nozzle formed in two pieces supported in end to end relationship with a gap between them. A pair of casting pool confinement plates are thrust against the ends of rolls by thrusters mounted with the side plastes on carriages forming part of moveable structures which are connected to the outer rends of nozzle pieces by pins and which can be moved by operation of screw jacks. The outer ends of nozzle segments can be accurately set in position relative to side plates prior to a casting and during a casting operation screw jacks can be operated so as to move the nozzle segments inwardly to match inward advance of the side plates as they wear.

20 Claims, 7 Drawing Sheets

STRIP CASTING APPARATUS

CROSS-REFERENCE TO RELATED APPLICATIONS

This application is a U.S. national counterpart application of international application serial No. PCT/AU00/00388 filed May 1, 2000, which claims priority to Australian application serial no. PQ 0071 filed May 3, 1999.

BACKGROUND AND SUMMARY OF THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and tend to produce defects caused by uneven solidification at the chilled casting surfaces of the rolls. One particular problem arises due to the formation of pieces of solid metal known as "skulls" in the vicinity of the pool confining side plates. These problems are exacerbated when efforts are made to reduce the superheat of the incoming molten metal. The rate of heat loss from the melt pool is greatest near the side plates due primarily to additional conductive heat transfer through the side plates to the roll ends. This high rate of local heat loss is reflected in the tendency to form "skulls" of solid metal in this region which can grow to a considerable size and fall between the rolls causing defects in the strip generally known as "snake eggs". It is therefore very important to maintain constant pool conditions in the region of the side plates. In particular, the setting of the gaps between the nozzle ends and the inner faces of the side plates is critically important.

We have determined that significant flow changes are brought about by variation in the position in the ends of the delivery nozzle relative to the side plates which may be brought about by inaccurate location of the delivery nozzle during set up and by subsequent movement of the nozzle ends due to thermal expansion during casting. This problem remains even if the nozzle is designed specifically to provide an increased flow of metal to the "triple point" regions (ie. where the side dams and casting rolls meet in the meniscus regions of the casting pool) to increase the heat input to these regions of the pool. Examples of such nozzles may be seen in U.S. Pat. Nos. 4,694,887, 5,221,511 and our earlier Australian Patent Application 35218/97 based on Provisional Application PO2367.

Although triple point pouring has been effective to reduce the formation of skulls in the triple point regions of the pool it has not been possible completely to eliminate the problem because the generation of defects is remarkably sensitive to even minor variations in the flow of metal into the triple point regions of the pool and movements of the nozzle ends due to thermal expansion during casting can be sufficient to cause defects. As the gap between the nozzle end and the side plate is reduced the downwardly inclined flow of metal from the triple point pouring passages in the ends of the nozzle impinges higher on the side plates. This can lead to the formation of skulls with subsequent snake egg defects or in extreme cases can cause the poured metal to surge upwardly in the reduced gap between the nozzle ends and side plates to spill over the upper edges of the side plates. This problem is addressed by the invention disclosed in our Australian Patent Application 63175/99 which provides an improvement by which it is possible to maintain substantially constant spacing between the nozzle ends and the side plates throughout casting.

According to the invention disclosed in Application 63175/99 there is provided apparatus for casting metal strip including

- a pair of parallel casting rolls forming a nip between them,
- an elongate metal delivery nozzle formed in a plurality of discrete elongate pieces disposed end to end,
- nozzle support means supporting the nozzle pieces such that the nozzle extends above and along the nip between the casting rolls for delivery of molten metal into the nip whereby to form a casting pool of molten metal supported above the nip,
- a pair of pool confinement plates at the ends of the nip,
- plate biasing means to bias the pool confinement plates against end surfaces of the rolls so that the plates move inwardly of the rolls to accommodate wear of the plates, and
- nozzle end shifter means to shift the nozzle pieces defining the outer nozzle ends on the support means with inward movements matching the inward movements of said side plates accommodating wear of the side plates thereby to maintain substantially constant spacings between the side plates and the nozzle ends.

In the specific apparatus disclosed in Application PP8024 the nozzle end shifter means comprised spacers disposed between the nozzle ends and the side plates to set the spacings between the nozzle ends and the side plates and through which the side plates push the nozzle ends inwardly as they move inwardly under the influence of the biasing means to accommodate wear of the side plates. We have now developed an alternative means for shifting the nozzle ends to provide more reliable control of the spacing between the nozzle ends and the side plates throughout casting. In accordance with this development the invention includes apparatus for casting metal strip including

- a pair of parallel casting rolls forming a nip between them,
- an elongate metal delivery nozzle formed in a plurality of discrete elongate pieces disposed end to end,
- nozzle support means supporting the nozzle pieces such that the nozzle extends above and along the nip between the casting rolls for delivery of molten metal into the nip whereby to form a casting pool of molten metal supported above the nip,
- a pair of pool confinement plates at the ends of the nip,
- plate biasing means to bias the pool confinement plates against end surfaces of the rolls so that the plates move inwardly of the rolls to accommodate wear of the plates, and nozzle end shifter means to shift the nozzle pieces defining the outer nozzle ends on the support means with inward movements matching the inward movements of said side plates accommodating wear of the side plates thereby to maintain substantially constant spacings between the side plates and the nozzle ends, wherein the nozzle end shifter means comprises a pair of moveable structures disposed one at each end of the casting roll assembly, moving means to move those structures longitudinally of the rolls, nozzle attachment means attaching the moveable structures to the two nozzle end pieces defining the outer nozzle ends so that those two nozzle pieces are moved with the movable structures, and control means responsive to inward advances of the side plates relative to the outer ends of the rolls to cause the moving means to move the moveable structures inwardly and so shift said two nozzle pieces with matching inward movements.

The plate biasing means may comprise a pair of generally horizontally acting thrusters actuable to apply opposing inward closure forces to the pool confinement plates and said moveable structures may provide abutments against which the thrusters react to apply the inward closure forces to the plates.

The moveable structures may comprise a pair of carriages which carry the thrusters and which are moveable toward and away from another to enable the spacing between them to be adjusted so that the carriages can be preset before a casting operation to suit the width of the casting rolls.

The moveable structures may include carriage drive means acting between outer end parts of the moveable structures and the carriages to move the carriages toward and away from one another.

The carriage drive means may comprise a pair of fluid operable cylinder units connected one to each of the carriages and to outer end parts of said moveable structures.

The moving means may act on the outer end parts of the moveable structures.

The moving means may comprise a pair of jacks connected to the outer end parts of the moveable structures. Those jacks may be electrically driven screw operated jacks.

The control means may be responsive to motion of the plate biasing means which produces inward movements of the pool confinement plates. The control means may, for example, include transducers in the plate thrusters to produce control signals indicative of movement of the thrusters and plates and connected in a control circuit with the moving means such that the moving means causes corresponding movements of the moveable structures and therefore said two nozzle pieces.

Alternatively the control means may include inspection means to observe the position of the pool confinement plates and to provide control signals dependant on observed changes in the position of those plates.

The moving means may be independently operable to adjust the initial setting of said two nozzle pieces relative to the plates.

BRIEF DESCRIPTION OF THE DRAWINGS

In order that the invention may be more fully explained, one particular embodiment will be described in some detail with reference to the accompanying drawings in which.

DETAILED DESCRIPTION OF THE DRAWINGS

Figure 1:
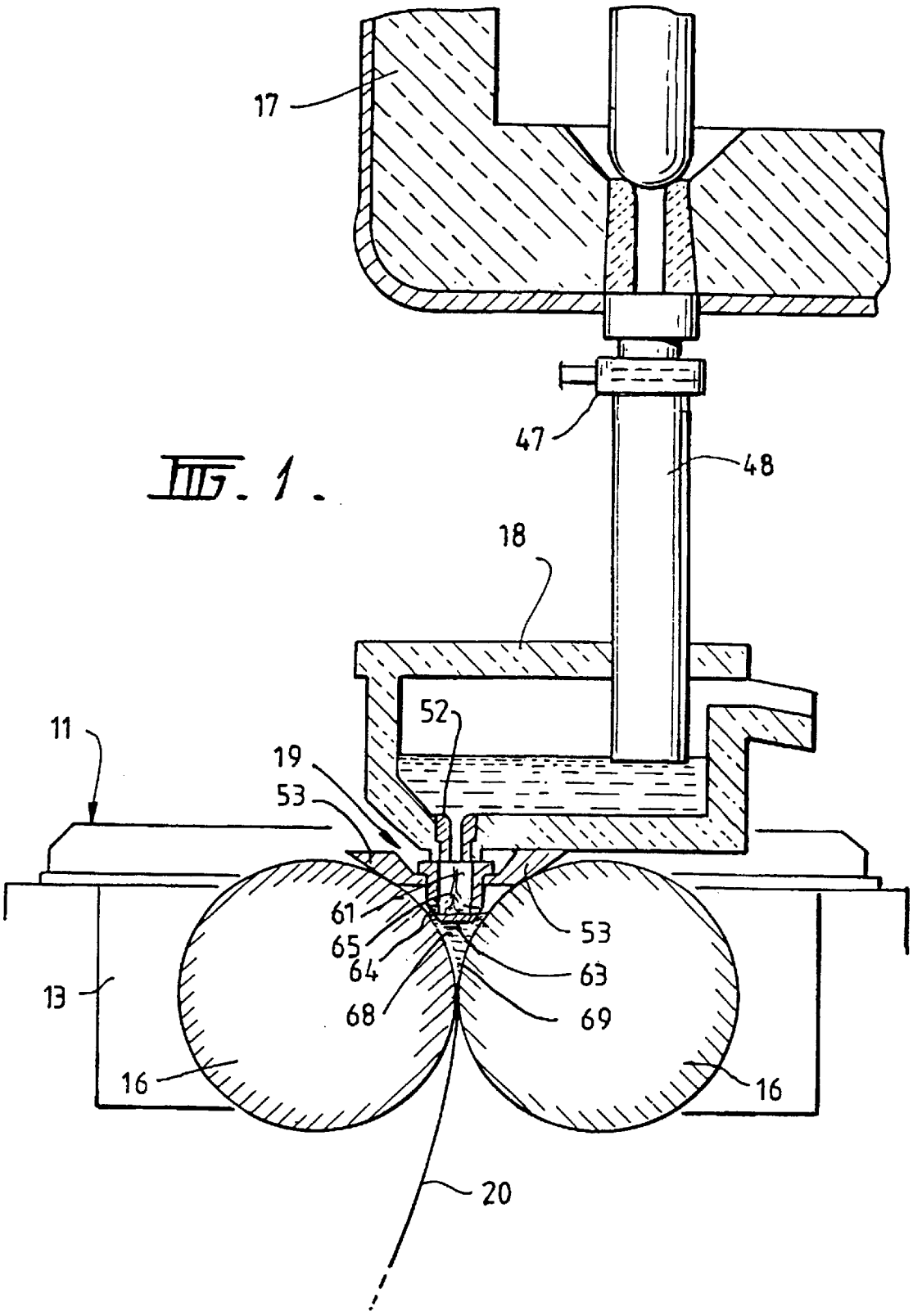
FIG. 1 is a vertical cross section through a strip caster constructed in accordance with the present invention.
Figure 2A:
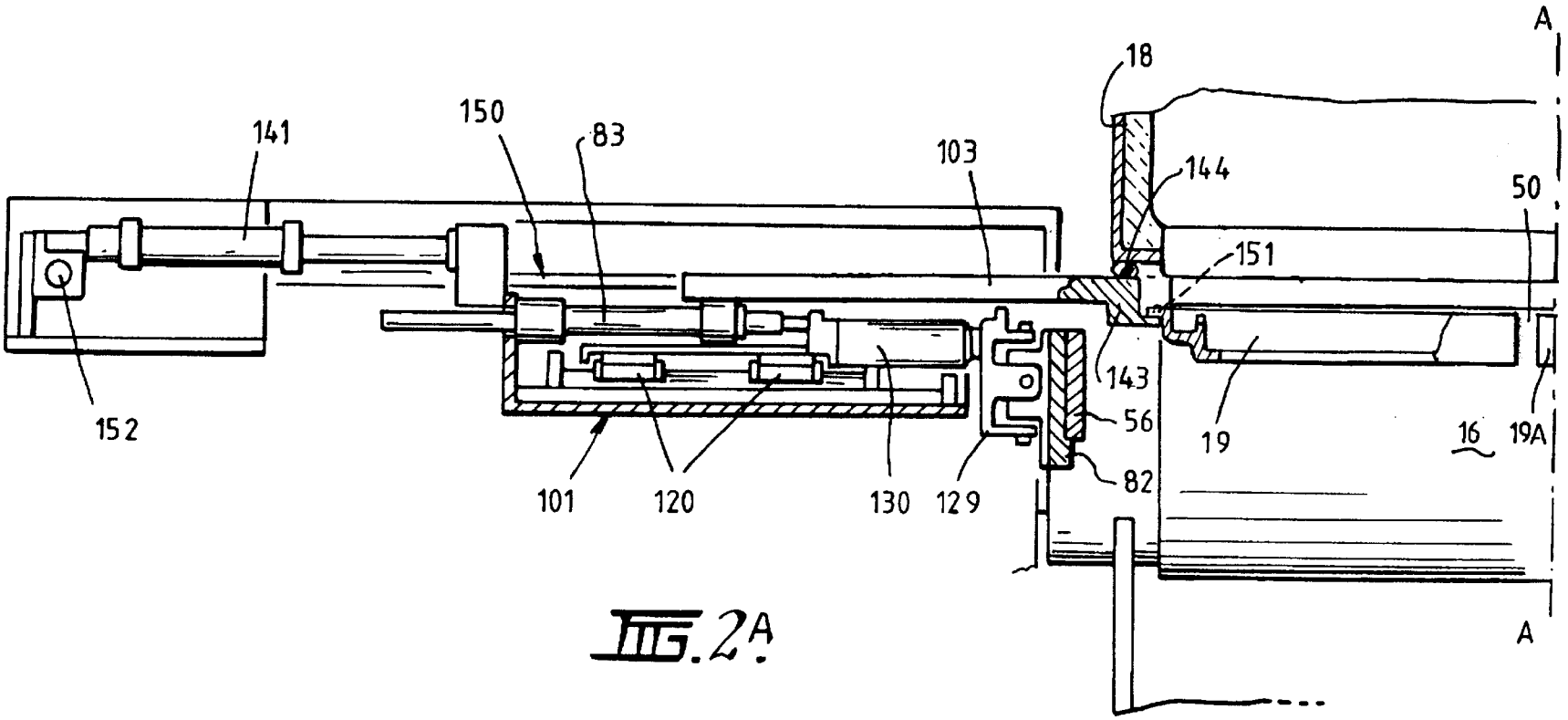
FIGS. 2A and 2B join on the line A-A to form a longitudinal cross section through important parts of the caster.
Figure 2B:
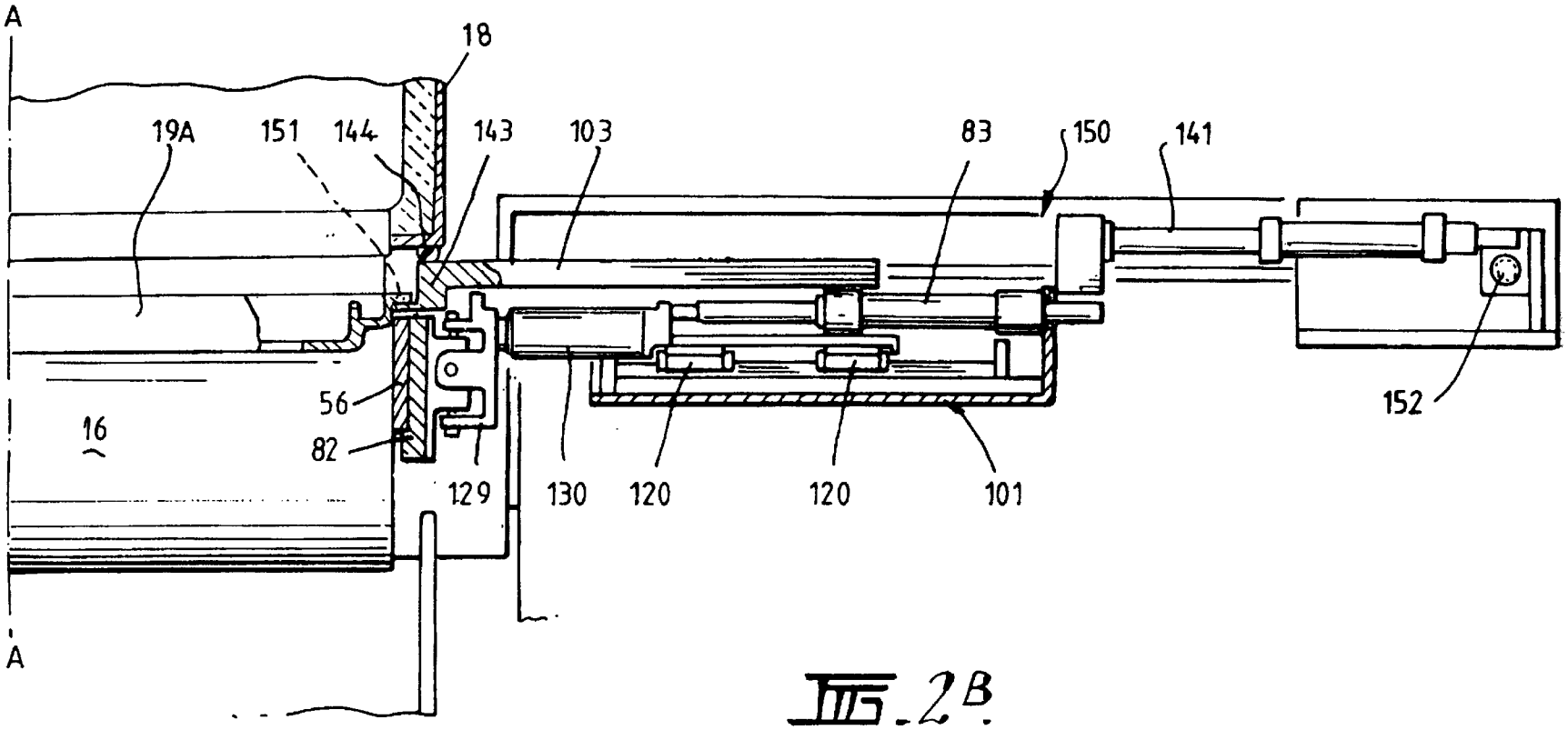
Figure 3:
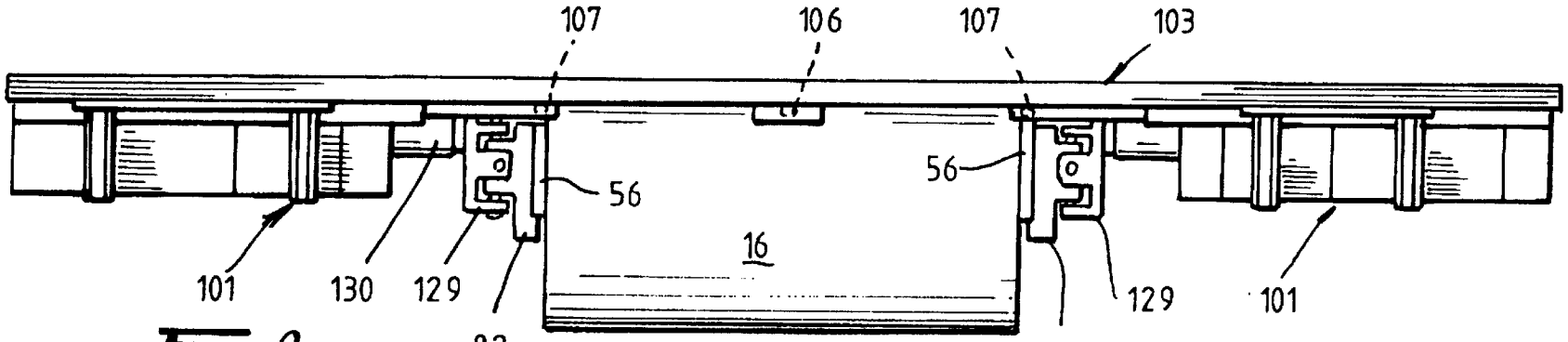
FIG. 3 is a side elevation of parts of the caster which provide support for a metal delivery nozzle.

The illustrated caster comprises a main machine frame 11 which supports a casting roll module in the form of a cassette 13 which can be moved into an operative position in the caster as a unit but can readily be removed when the rolls are to be replaced. Cassette 13 carries a pair of parallel casting rolls 16 to which molten metal is supplied during a casting operation from a ladle (not shown) via a tundish 17, distributor 18 and delivery nozzle 19 to create a casting pool 30. Casting rolls 16 are water cooled so that shells solidify on the moving roll surfaces and are brought together at the nip between them to produce a solidified strip product 20 at the roll outlet. This product may be fed to a standard coiler.

Casting rolls 16 are contra-rotated through drive shafts from an electric motor (not shown) connected to a transmission mounted on the main machine frame. The drive shafts can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts which are connected to water supply hoses through rotary glands. The roll may typically be about 500 mm diameter and up to 2000 mm long in order to produce strip product approximately the width of the rolls.

The ladle is of entirely conventional construction and is supported on a rotating turret whence it can be brought into position over the tundish 17 to fill the tundish. The tundish may be fitted with a sliding gate valve 47 actuable by a servo cylinder to allow molten metal to flow from the tundish 17 through the valve 47 and refractory shroud 48 into the distributor 18.

The distributor 18 is formed as a wide dish made of a refractory material such as magnesium oxide (MgO). One side of the distributor 18 receives molten metal from the tundish 17 and the other side of the distributor 18 is provided with a series of longitudinally spaced metal outlet openings. The lower part of the distributor 18 carries mounting brackets 53 for mounting the distributor onto the main caster frame 11 when it is installed in its operative position.

Delivery nozzle 19 is made of two discrete elongate pieces 19A formed as identical nozzle half segments of a refractory material such as alumina graphite. The pieces are supported so as to be disposed in end to end relationship with a gap 50 between them.

Figure 4:
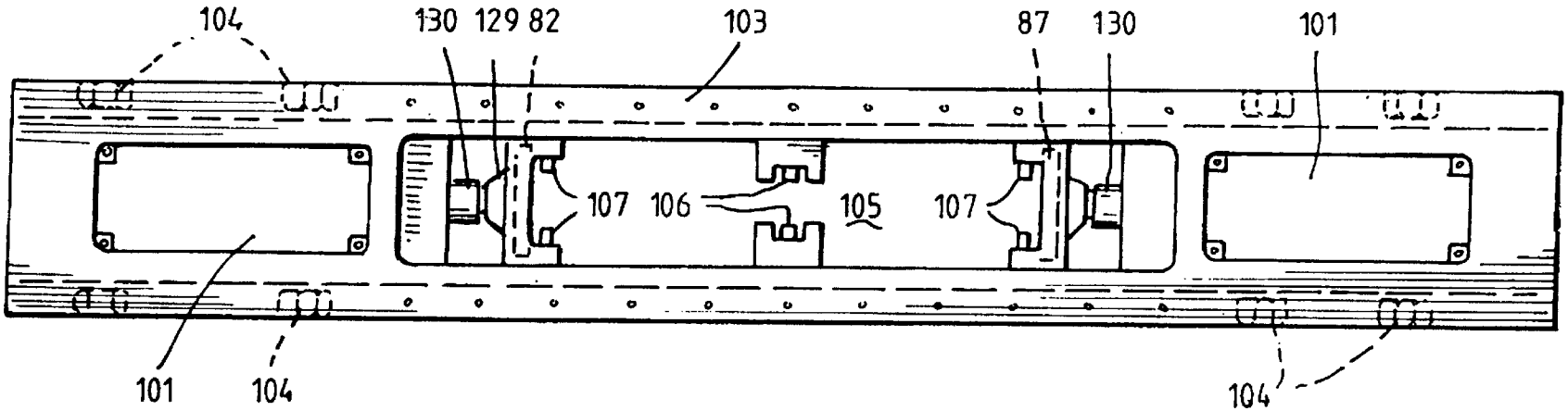
FIG. 4 is a plan view of the components shown in FIG. 3.
Figure 5:
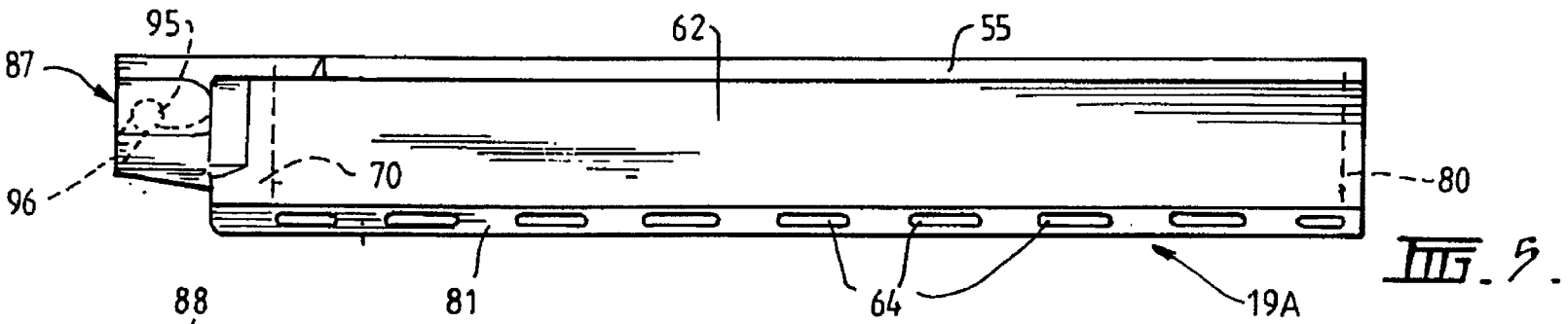
FIG. 5 is a side elevation of a one half segment of the metal delivery nozzle.
Figure 6:
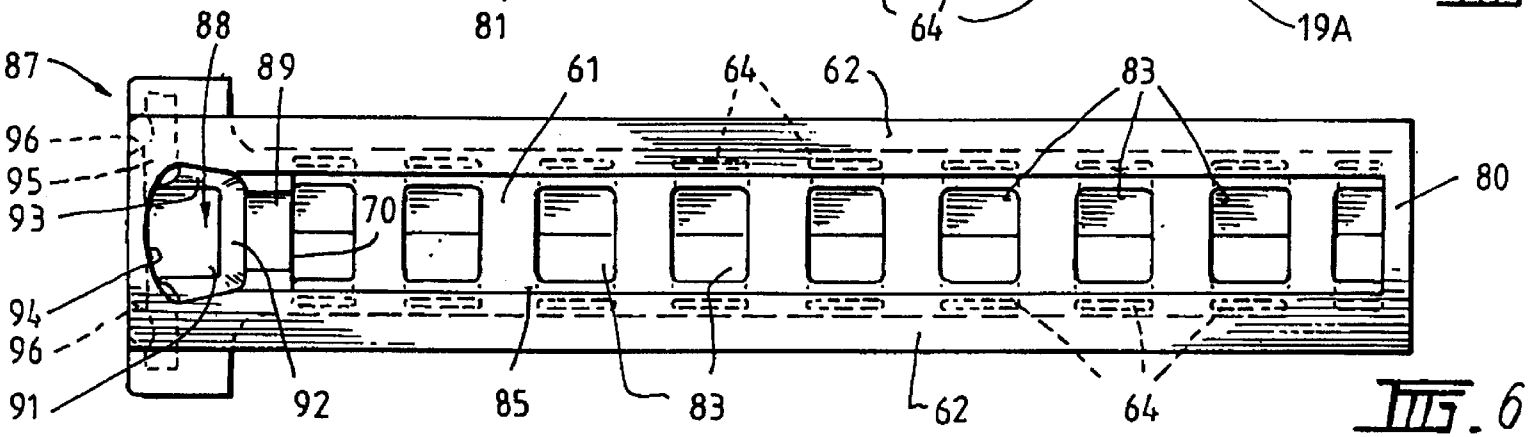
FIG. 6 is a plan view of the nozzle segment shown in FIG. 5.
Figure 7:
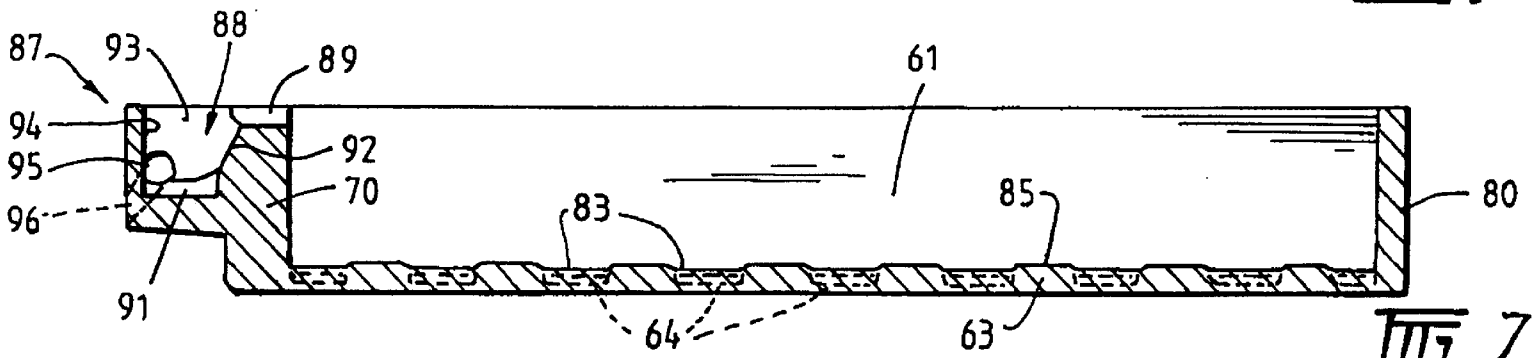
FIG. 7 is a longitudinal cross-section through the delivery nozzle segment.
Figure 8:
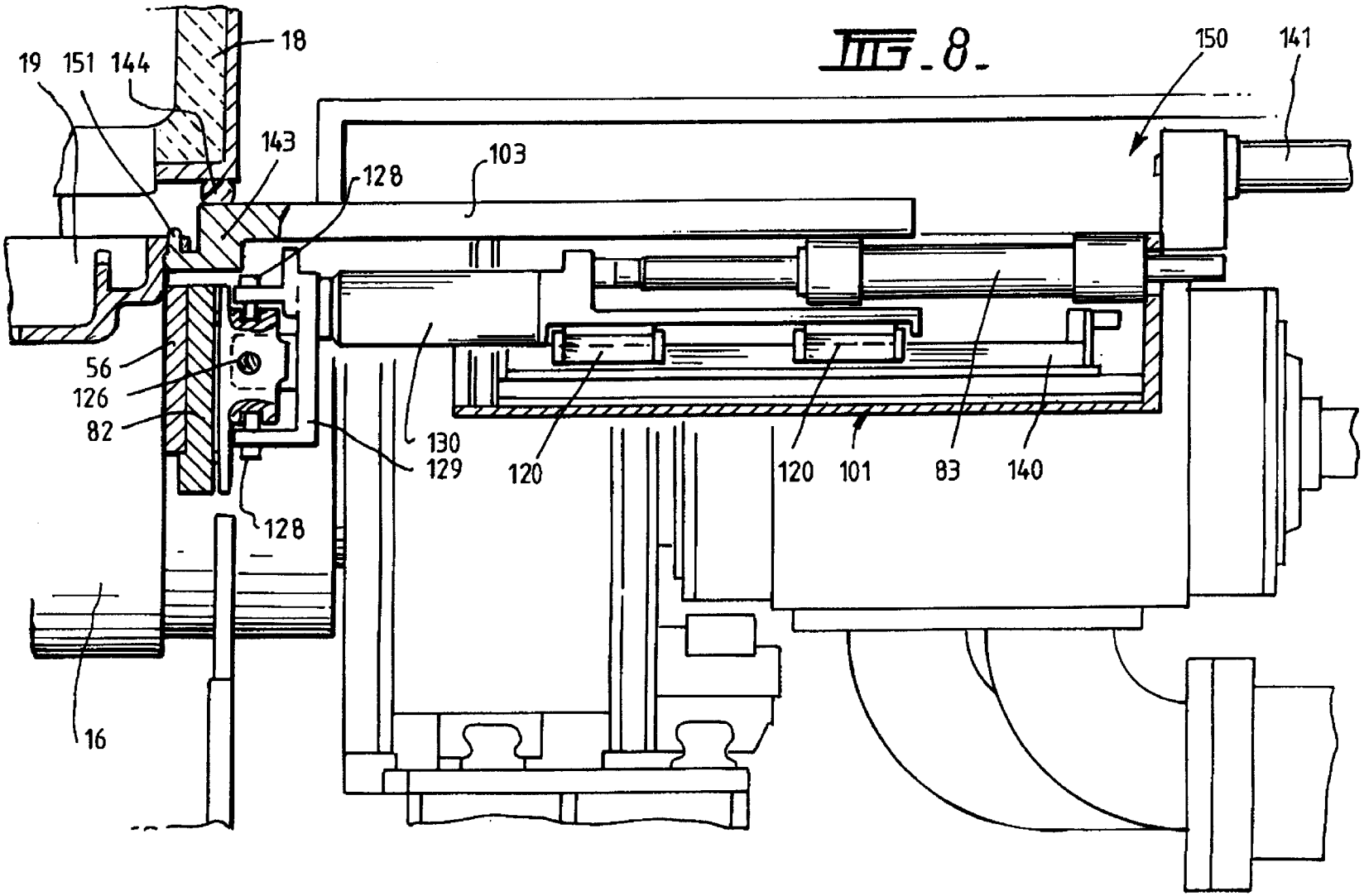
FIG. 8 is an enlarged vertical cross section through components at one end of the caster.
Figure 9:
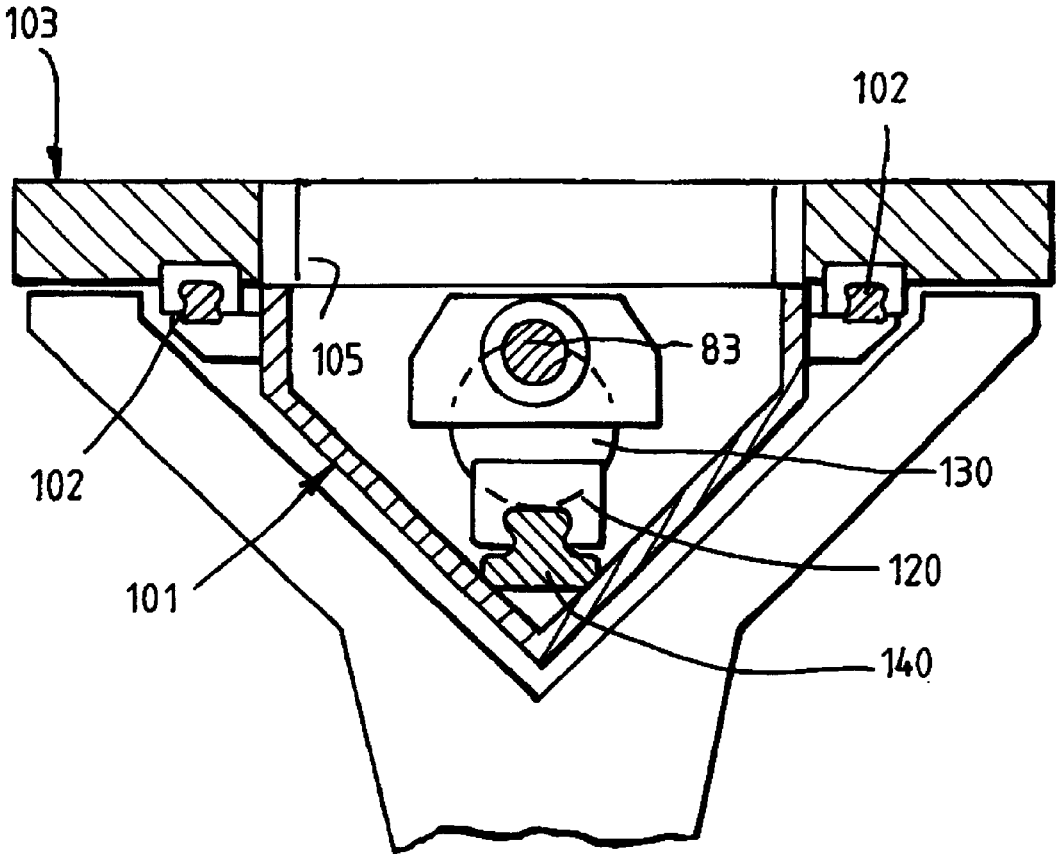
FIG. 9 is a transverse cross section through the components shown in FIG. 8.

The construction of the nozzle pieces 19A is illustrated in FIGS. 4 to 6. Each nozzle piece is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle pieces 19A which are spaced apart to form the gap 50. The bottom of the trough is closed by a horizontal bottom floor 63 which meets the trough side walls 62 at chamfered bottom corners 81. The nozzle is provided at these bottom corners with a series of side openings in the form of longitudinally spaced elongate slots 64 arranged at regular longitudinal spacing along the nozzle. Slots 64 are positioned to provide for egress of molten metal from the trough at the level of the trough floor 63. The trough floor is provided adjacent the slots with recesses 83 which slope outwardly and downwardly from the centre of the floor toward the slots and the slots continue as extensions of the recesses 83 to slot outlets 64 disposed in the chamfered bottom corners 81 of the nozzle beneath the level of the upper floor surface 85.

The outer ends of the nozzle segments are provided with triple point pouring end formations denoted generally as 87 extending outwardly beyond the nozzle end wall 70. Each end formation 87 defines a small open topped reservoir 88 to receive molten metal from the distributor, this reservoir being separated from the main trough of the nozzle by the end wall 70. The upper end 89 of end wall 70 is lower than the upper edges of the trough and the outer parts of the reservoir 88 and can serve as a weir to allow back flow of molten metal into the main nozzle trough from the reservoir 88 if the reservoir is over filled, as will be more fully explained below.

Reservoir 88 is shaped as a shallow dish having a flat floor 91, inner and side faces 92, 93 and a curved upright outer face 94. Although side faces 92, 93 are shown as inclined to the vertical they may be formed to stand straight up from the floor 91 so as to be essentially vertical. A pair of triple point pouring passages 95 extend laterally outwardly from reservoir 88 just above the level of the floor 91 to connect with triple point pouring outlets 96 in the undersides of the nozzle end formations 87, the outlets 96 being angled downwardly and inwardly to deliver molten metal into the triple point regions of the casting pool.

Molten metal falls from the outlet openings 52 of the distributor in a series of free-falling vertical streams 65 into the bottom part of the nozzle trough 61. Molten metal flows from this reservoir out through the side openings 64 to form a casting pool 68 supported above the nip 69 between the casting rolls 16.

The pool is confined at the ends of the rolls by a pair of side closure plates 56 which are held against stepped ends of the rolls when the roll cassette is in its operative position. Side closure plates 56 are made of a strong refractory material, for example boron nitride, and have scalloped side edges to match the curvature of the stepped ends of the rolls. The side plates are mounted in plate holders 82 which are movable by actuation of a pair of thrusters 83 to bring the side plates into engagement with the stepped ends of the casting rolls to form end closures for the molten pool of metal formed on the casting rolls during a casting operation.

Removable roll cassette 13 may be constructed in the manner described in our Australian Patent Application 84244/98 so that the casting rolls 16 can be set up and the nip between them adjusted before the cassette is installed in position in the caster. Details of the cassette construction, which are fully described in Patent Application 84244/98, form no part of the present invention and need no further description in this context.

The pool confining side plates 56 and thrusters 83 are mounted on a pair of carriages denoted generally as 101 disposed one at each end of the roll assembly and moveable toward and away from one another to enable the spacing between them to be adjusted. The carriages can thus be preset before a casting operation to suit the width of the casting rolls and to allow quick roll changes for differing strip widths. Carriages 101 are hung from linear tracks 102 on the under side of a fixed rectangular plate frame 103 which is mounted on the main machine frame by clamps 104 so as to extend horizontally above the casting rolls and to extend beyond them at the two ends of the caster. Rectangular plate frame 103 is disposed beneath the metal distributor vessel 18 and has a central rectangular opening 105 to receive the metal delivery nozzle 19. The mid part of frame 103 is provided with inwardly projecting delivery nozzle supports 106 to engage upper flanges at the inner ends of the two delivery nozzle half pieces 19A and 19B, whereas the outer ends of the delivery nozzle pieces are supported on nozzle support pins 107 mounted on the inner ends of the two carriages 101 so as to project inwardly of the rectangular fixed frame opening 105 but to be moveable in and out with the carriages 101.

Side plates in holders 82 are pivotally connected to the thrusters 83 so that the side plates can tilt about the pivot connections and the thrusters apply opposing forces through the pivots. The pivot connections are provided in such a way that each side plate can rock longitudinally of the rolls by pivoting movement about a horizontal pivot axis transverse to the rolls and can rock laterally of the rolls by pivoting movement about a vertical pivot axis perpendicular to the horizontal pivot axis, the pivoting movement of the plates being confined to movements about those two specific axes so that planar rotation of the plates is prevented.

Side plate holders 82 are pivotally connected by a horizontal pivot pins 126 and a pair of vertical pivot pins 128 to a thruster body 129 at the end of a thruster rod 130 of the respective thruster 83. Thruster rod 130 is supported by a pair of linear bearings 120 on a track 140 on the carriage. The vertical pivot pins 128 are fixed to thruster body 129 and fit into elongate slots in the plate holder. The slots are elongate in the direction longitudinal to the thruster 83 to leave small clearance gaps about the pivot pins 128 which permit limited rocking movement of the plate holder about horizontal pin 121 longitudinally of the rolls.

Horizontal pivot pin 126 is also mounted on the thruster body 129 and engages an internally convex bearing in the plate holder so that the plate holder 125 can rock laterally of the casting rolls about the vertical axis defined by the pivot pins 128. The degree to which the plate holder is free to rock in this manner may be limited by engagement with stops on the thruster body 129.

The horizontal pivot pins 126 are located at such a height above the level of the nip between the casting rolls that the effect of the outward pressure on the side plates due to the molten metal in the casting pool is such as to rotationally bias the side plates about the pivots in such directions that their bottom ends are biased inwardly so as to produce increased sealing pressure at the bottom of the casting pool. The arrangement permits tilting of the side plates so as to accommodate deformation of the casting roll end surfaces due to thermal expansion during casting and at the same time maintains a biasing action which increases the sealing forces at the bottom of the pool so as to counter-act the increased ferrostatic pressure at the bottom of the pool where there is accordingly the greatest tendency for leakage.

Appropriate positioning of the pivots will depend on the diameter of the casting rolls, the height of the casting pool and thickness of the strip being cast. The manner in which correct positioning of the pivots can be determined is fully described in our Australian Patent 693256 and U.S. Pat. No. 5,588,479.

Carriages 101 can be moved along the linear tracks 102 on frame 103 by operation of a pair of fluid operated carriage positioning cylinder units 141, which may be pneumatically or hydraulically operated, fixed to the outer ends of carriages 101 and to a pair of electrically operated screw jacks 152 mounted on the machine frame. Cylinder units 141 have two fixed positions so that they can set the carriages in two alternative positions for two different cast strip widths. The setting of the carriages in this way then automatically sets the plate holders in appropriate positions so as to be brought into engagement and firmly pressed against the ends of the casting rolls by operation of the thrusters 83. At the same time, the setting of the carriages moves the outer delivery nozzle support pins 107 into positions to support outer ends of the core nozzle 19 appropriate to the width of the strip to be cast, since the relative positioning of the core nozzle supports and the plate holders is maintained.

Carriages 101 also carry inner bridges 143 which seal against the outer ends of the distribution vessel 18 via seals 144. The bridges 143 are located directly above the side plate holders 82 and will thus fit against the outer ends of the distribution vessel of appropriate width chosen for the size of the strip to be cast thereby to provide a sealed enclosure above the casting pool to enable casting in an inert atmosphere. One or both bridges 143 may also serve as camera supports to support casting pool observation cameras to monitor the condition of the casting pool during casting.

With the above construction movement of the carriages is effective to set not only the position of the side dams appropriate to the width of the strip to be cast, but also automatically positions the bridges 143 with the casting pool seals 144 and the casting pool observation cameras without the need for individual adjustment or setting of any of these components.

During casting the core nozzle pieces 19A undergo very significant thermal expansion through contact with the molten steel at temperatures of the order of 1570° C. or more. In a typical installation each nozzle piece 19A may for example be about 650 cm long and the thermal expansion may produce a change in length of up to 12 mm. The gap between the core nozzle ends and the side dams will usually be of the order of 15 mm to produce effective triple point pouring of molten metal across the side dams. Accordingly the thermal expansion of the nozzle is very significant and can lead to a severe reduction in the gap between the nozzle ends and the side dams, causing the molten metal leaving the triple point pouring passages 95 to impinge on the upper parts of the side dams above the casting pool leading to the formation of skulls and in extreme cases spilling of metal over the upper edges of the side dams. Moreover the side plates wear only at their margins which engage the end faces of the rolls. The inner parts of the side plates between these margins remain unworn and as wear of the plates continues they are projected inwardly from the ends of the rolls so decreasing the effective gap between the side plates and the nozzle ends. The present invention enables both of these problems to be overcome by incorporating the thruster carriages 101 and carriage setting cylinder units 141 as parts of two moveable structures denoted generally as 150 which are connected to the outer ends of the two nozzle pieces 19A by pins 151 and which can be moved bodily in and out by the operation of a pair of screw jacks 152. With this arrangement the carriages 101 are incorporated with the carriage drive cylinders 141 in the moveable structures 150 which can be moved by operation of jacks 152 to move the two nozzle segments. Pins 151 are located at the outer ends of the nozzle pieces 19A so the locations of the nozzle ends are accurately determined by the positions of moveable structures 150. This enables the outer ends of the nozzle segments to be accurately set in position relative to the side plates prior to a casting operation. Moreover during a casting operation the screw jacks can be operated so as to move the nozzle segments inwardly to match inward advance of the side plates as they wear so as very accurately to maintain the initially set gap between the nozzle ends and the side plates. The positioning of the nozzle ends is not significantly affected by thermal expansion of the nozzle because the ends are located through pins 51 and the nozzle pieces will expand inwardly.

Screw jacks 152 may be operated by electric motors connected into a control circuit receiving control signals determined by measurement of the gap variation or by some means which measures advance of the side plates. For example the thruster cylinders 83 may incorporate linear velocity displacement transducers to respond to the extension of the thrusters to provide signals indicative of inward movement of the side plates and connected in the control circuit with position encoders (rotary) on the screw jacks to determine the positions of the nozzle ends. Alternatively small water cooled video cameras may be installed on the bridges 143 to directly observe the gaps between the side plates and the nozzle ends and to produce control signals to be fed to the position encoders on the screw jacks. With either arrangement it is possible to achieve very precise control of the gap between the inner faces of the side plates and the outer ends of the nozzle. Moreover the gaps can be accurately set by independent operation of the screw jacks prior to casting.

What is claimed is:

1. An apparatus for casting metal strip including a pair of parallel casting rolls forming a nip between them, an elongate metal delivery nozzle formed in a plurality of discrete elongate pieces disposed end to end, nozzle support means supporting the nozzle pieces such that the nozzle extends above and along the nip between the casting rolls for delivery of molten metal into the nip whereby to form a casting pool of molten metal supported above the nip, a pair of pool confinement plates at the ends of the nip, plate biasing means to bias the pool confinement plates against end surfaces of the rolls so that the plates move inwardly of the rolls to accommodate wear of the plates, and nozzle end shifter means to shift the nozzle pieces defining the outer nozzle ends on the support means with inward movements matching the inward movements of said side plates accommodating wear of the side plates thereby to maintain substantially constant spacings between the side plates and the nozzle ends, wherein the nozzle end shifter means comprises a pair of moveable structures disposed one at each end of the casting roll assembly, moving means to move those structures longitudinally of the rolls, nozzle attachment means attaching the moveable structures to the two nozzle end pieces defining the outer nozzle ends so that those two nozzle pieces are moved with the movable structures, and control means responsive to inward advances of the side plates relative to the outer ends of the rolls to cause the moving means to move the moveable structures inwardly and so shift said two nozzle pieces with matching inward movements.

2. The apparatus of claim 1, wherein the plate biasing means comprises a pair of generally horizontally acting thrusters actuable to apply opposing inward closure forces to the pool confinement plates and said moveable structures provide abutments against which the thrusters react to apply the inward closure forced to the side plates.

3. The apparatus of claim 2, wherein the moveable structures comprise a pair of carriages which carry the thrusters and which are moveable toward and away from another to enable the spacing between them to be adjusted so that the carriages can be preset before a casting operation to suit the width of the casting rolls.

4. The apparatus of claim 3, wherein the moveable structures include carriage drive means acting between outer end parts of the moveable structures and the carriages to move the carriages toward and away from one another.

5. The apparatus of claim 4, wherein the carriage drive means comprises a pair of fluid operable cylinder units connected one to each of the carriages and to outer end parts of said moveable structures.

6. The apparatus of claim 1, wherein the moving means acts on outer end parts of the moveable structures.

7. The apparatus of claim 6, wherein the moving means comprises a pair of jacks connected to the outer end parts of the moveable structures.

8. The apparatus of claim 7, wherein the jacks are electrically driven screw operated jacks.

9. The apparatus of claim 1, wherein the control means is responsive to motion of the plate biasing means which produces inward movements of the side plates.

10. The apparatus of claim 2, wherein the control means includes transducers in the plate thrusters to produce control signals indicative of movement of the thrusters and the plates and connected in a control circuit with the moving means such that the moving means causes corresponding movements of the moveable structures and therefore said two nozzle pieces.

11. The apparatus as claimed claim 1, wherein the control means includes inspection means to observe the position of the pool confinement plates and to provide control signals dependent on observed changes in the position of those plates.

12. The apparatus of claim 1, wherein the moving means is independently operable to adjust the initial setting of said two nozzle pieces relative to the side plates.

13. The apparatus of claim 2, wherein the moving means acts on outer end parts of the moveable structures.

14. The apparatus of claim 3, wherein the moving means acts on outer end parts of the moveable structures.

15. The apparatus of claim 4, wherein the moving means acts on outer end parts of the moveable structures.

16. The apparatus of claim 5, wherein the moving means acts on outer end parts of the moveable structures.

17. The apparatus of claim 2, wherein the control means is responsive to motion of the plate biasing means which produces inward movements of the side plates.

18. The apparatus of claim 3, wherein the control means includes transducers in the plate thrusters to produce control signals indicative of movement of the thrusters and the plates and connected in a control circuit with the moving means such that the moving means causes corresponding movements of the moveable structures and therefore said two nozzle pieces.

19. The apparatus of claim 2, wherein the control means includes inspection means to observe the position of the pool confinement plates and to provide control signals dependent on observed changes in the position of those plates.

20. The apparatus of claim 2, wherein the moving means is independently operable to adjust the initial setting of said two nozzle pieces relative to the side plates.

* * * * *

UNITED STATES PATENT AND TRADEMARK OFFICE

CERTIFICATE OF CORRECTION

PATENT NO. : 6,588,492 B1 
DATED : July 8, 2003
INVENTOR(S) : John Andrew Fish and Heiji Kato It is certified that error appears in the above-identified patent and that said Letters Patent is hereby corrected as shown below:

Drawings,
Sheet 5, Figs and 7, reference numeral "83", each occurrence, should read -- 30 --.

Column 5,
Lines 10 and 12, reference numeral "83", each occurrence, should read -- 30 --.

Signed and Sealed this

Fourteenth Day of October, 2003

JAMES E. ROGAN
*Director of the United States Patent and Trademark Office*